US006713017B1

(12) United States Patent
Yoshizawa et al.

(10) Patent No.: US 6,713,017 B1
(45) Date of Patent: Mar. 30, 2004

(54) METAL-FLAKE MANUFACTURING APPARATUS

(75) Inventors: Hiroki Yoshizawa, Yokohama (JP); Kenji Matsuda, Matsudo (JP); Kiyoshi Nebashi, Yokohama (JP)

(73) Assignee: Ishikawajima-Harima Jukogyo Kabushiki Kaisha, Tokyo (JP)

( * ) Notice: Subject to any disclaimer, the term of this patent is extended or adjusted under 35 U.S.C. 154(b) by 13 days.

(21) Appl. No.: 09/868,905

(22) PCT Filed: Nov. 2, 2000

(86) PCT No.: PCT/JP00/07743

§ 371 (c)(1),
(2), (4) Date: Jul. 9, 2001

(87) PCT Pub. No.: WO01/34326

PCT Pub. Date: May 17, 2001

(30) Foreign Application Priority Data

Nov. 9, 1999 (JP) ..... 11-318340
Aug. 23, 2000 (JP) ..... 2000-251912

(51) Int. Cl.[7] ..... B22D 11/06
(52) U.S. Cl. ..... 266/202; 75/331
(58) Field of Search ..... 266/202; 164/130, 164/335; 75/331

(56) References Cited

U.S. PATENT DOCUMENTS 4,215,084 A * 7/1980 Maringer ..... 164/130
5,665,177 A 9/1997 Fukuno et al.

FOREIGN PATENT DOCUMENTS

JP 60-261648 12/1985
JP 362074007 A * 4/1987 ..... 164/129
JP 63-149053 6/1988
JP 64-18550 1/1989
JP 64-31559 2/1989
JP 1-170553 7/1989
JP 8-47751 2/1996
JP 8-197202 8/1996

OTHER PUBLICATIONS

W. A. Heinemann, Rapidly Quenched Metals, pp. 27–34, "Rapid Solidification," Dec. 1985.
G. Haour, et al., Wire Industry, pp. 186–189, "Rapid Casting of Metallic Wires and Ribbons," Mar. 1980.
J. Ishihara, et al., J. Japan Inst. Metals, vol. 46, No. 1, pp. 94–99, Non–Uniformity of the Thickness by Amorphous Ribbon Made by the Double Roller Quenching Method, Dec. 1982, (with partial English translation).

* cited by examiner

*Primary Examiner*—Scott Kastler
(74) *Attorney, Agent, or Firm*—Oblon, Spivak, McClelland, Maier & Neustadt, P.C.

(57) ABSTRACT

Cooling rolls are spaced to have a gas of a size greater than thickness of metal thin bodies to be produced. A nozzle is arranged to eject molten metal onto a surface of the cooling roll. The first cooling roll quenches molten metal ejected from the nozzle into metal thin bodies. On the next cooling roll, the produced metal thin bodies are hit into flakes and excessive molten metal is made into metal thin bodies. Thus, freedom of supplying the molten metal flakes can be efficiently produced.

12 Claims, 8 Drawing Sheets

METAL-FLAKE MANUFACTURING APPARATUS

TECHNICAL FIELD

The present invention relates to a metal-flake, manufacturing apparatus which can simply and efficiently manufacture quenched metal-flake materials required for manufacture of thermoelectric materials, magnet materials, hydrogen absorbing alloys or the like.

BACKGROUND ART

Thermoelectric materials, magnet materials, hydrogen absorbing alloys or the like, which may be often intermetallic compounds, may be produced by crushing ingots. Conceived as an alternative way aimed at effective improvement of performances is to use quenched metal-flake materials, which way utilizes, as quench effects, compositional uniformity and crystal orientation along a quenching direction.

Such metal flakes are produced by preliminarily producing a continuous, wide-width thin strip and then crushing or shearing this continuous thin strip. Mainly used to produce such continuous thin strip is a single or double roll method.

In the single roll method, as illustrated in FIG. 1A, molten metal is ejected from a nozzle 2 arranged above a cooling roll 1 to stably keep a molten metal reservoir (puddle), using surface tension of the molten metal, on a top of the cooling roll 1 which contacts the molten metal, thereby producing a continuous, wide-width thin strip which is received in a storage box 3.

In the double roll method, as shown in FIG. 1B, just above a nip between two cooling rolls 4 which are arranged to contact with each other, molten metal is fed through a nozzle 5 and is solidified and rolled down between the cooling rolls 4, thereby producing a continuous thin strip which has been cooled at its opposite surfaces.

The single roll method, however, has a problem that the molten metal reservoir (puddle) is difficult to stably keep at the top of the cooling roll 1. If the molten metal is excessively ejected, the molten metal reservoir may become unstable and drop sideways or backward of the cooling roll 1 or get mixed with the thin strip product to thereby lower the uniformity of the finished product.

In the double roll method, on the other hand, the cooling rolls 4 are used not only for cooling and solidification operations but also for rolling-down operation so that a large drive power is required for the cooling rolls 4 and the cooling rolls 4 tend to be severely damaged.

Moreover, obtained as a product in either of the conventional methods is a continuous thin strip which is low in bulk density. Therefore, a large-sized storage box is required; alternatively, a separate crusher or shearing machine is required upstream of a storage box.

SUMMARY OF THE INVENTION

The present invention was made in view of the above problems of the prior art and has its object to provide a metal-flake manufacturing apparatus which can overcome the problem on stable supply of molten metal in the single roll method and the problem on roll-drive power in the double roll method and which can manufacture quenched metal-flake materials in a simple and highly efficient manner.

The inventors have reviewed quenched metal materials required for manufacture of thermoelectric materials, magnet materials, hydrogen absorbing alloys or the like to find out that utilized as quench effects in a thin strip are compositional uniformity and crystal orientation along a quenching direction and that to provide a continuous thin strip is not always a requisite since the thin strip is sheared or crushed in a next step. The invention was completed on the basis of such findings.

More specifically, in order to overcome the above problems, a plurality of cooling rolls are spaced to have a gap or gaps of a size greater than thickness of metal thin bodies to be produced. A nozzle is provided to eject molten metal onto a surface of such cooling roll. The first cooling roll quenches the molten metal from the nozzle into metal thin bodies. On the next cooling roll, the produced metal thin bodies are hit into flakes while the excess molten metal is made into metal thin bodies. Thus, freedom in supply of molten metal is enhanced and metal flakes can be stably and efficiently produced.

The cooling rolls are arranged at different heights so that the produced metal thin bodies are sequentially hit on the rolls, which increases chances of the produced metal thin bodies being hit on the cooling rolls and contributes to obtaining further finer flakes and changeability of the flake withdrawal direction.

Rotational axes of the cooling rolls may be out of parallelism so that a flying direction of the metal thin bodies, which is on a plane perpendicular to the rotational axis, may be changed with increased freedom.

Moreover, the cooling rolls may be arranged to rotate at different peripheral velocities. Differentiation in peripheral velocity between the cooling rolls will contribute to controlling the thickness of the metal thin bodies produced; if the cooling rolls with the same diameter were driven to rotate at the same peripheral velocity, thinner and thicker metal flakes would be produced on the upstream and downstream rolls, respectively.

In addition, the cooling rolls may have different diameters so as to have different peripheral velocities, which will contribute, just like the above, to controlling the thickness of the metal thin bodies.

The nozzle may have a plurality of nozzle openings along the axis of the cooling roll. Provision of the nozzle openings in the shape of, for example, slot or a circle, along the axis of the roll will contribute to further effective production of metal flakes.

The nozzle opening may have a sectional area of 0.7878–78 $mm^2$. Even with the nozzle openings having the sectional area as large as of 28–78 $mm^2$, which are unusually large as compared with those in the conventional production of metal flakes, thick metal flakes can be produced with higher efficiency. The shape of the nozzle openings are not limited to circle.

The nozzle and the cooling rolls may be placed in atmospheric gas and windbreak members may be arranged to prevent the atmospheric gas from being swirled by the rotating cooling rolls. Manufacturing in the atmosphere such as inert gas will enhance the quality of the metal flakes produced. Prevention of the atmospheric gas from being swirled by the rotating cooling rolls will prevent the nozzle-from being cooled and prevent the metal flakes from being scattered.

Furthermore, gas from atmospheric gas supply nozzles may be directed to guide the metal flakes towards a storage box in which metal flakes are to be stored, which will prevent the metal flakes from being scattered and contribute to efficient collection of the metal flakes in the box.

The storage box may have a cooler for cooling the collected metal flakes, which will contribute to further improvement of the metal flake cooling efficiency.

BEST MODE FOR CARRYING OUT THE INVENTION

Embodiments of the invention will be described with reference to the drawings.

Figure 1A:
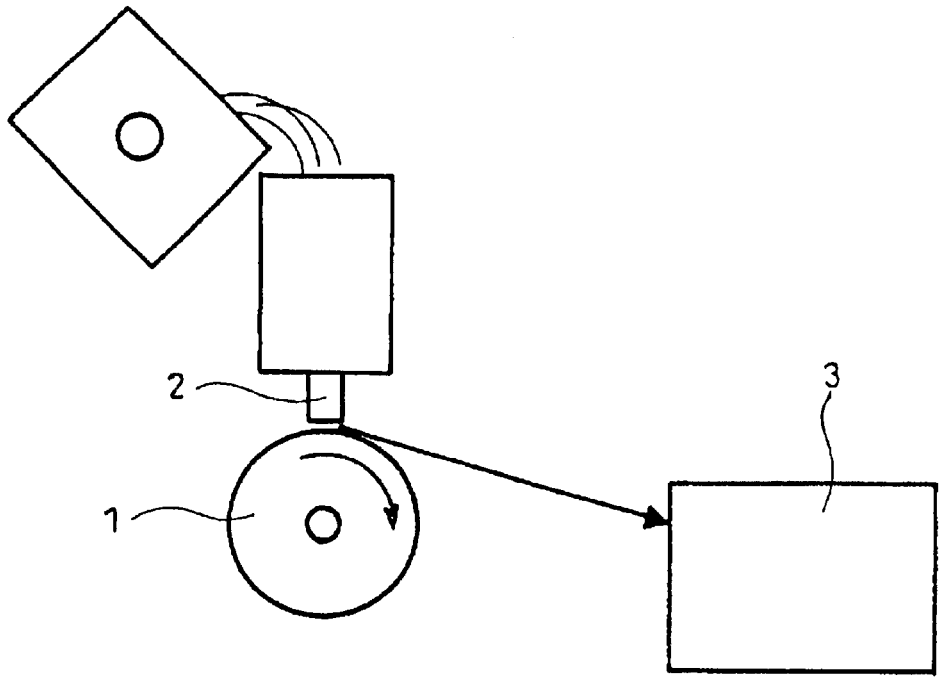
FIGS. 1A and 1B are illustrations of single and double roll methods, respectively, with respect to conventional metal thin strip manufacturing apparatuses.
Figure 1B:
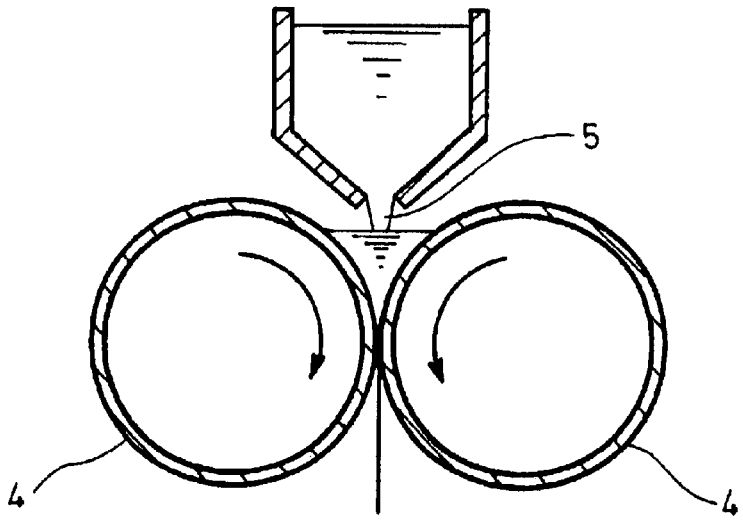
Figure 2:
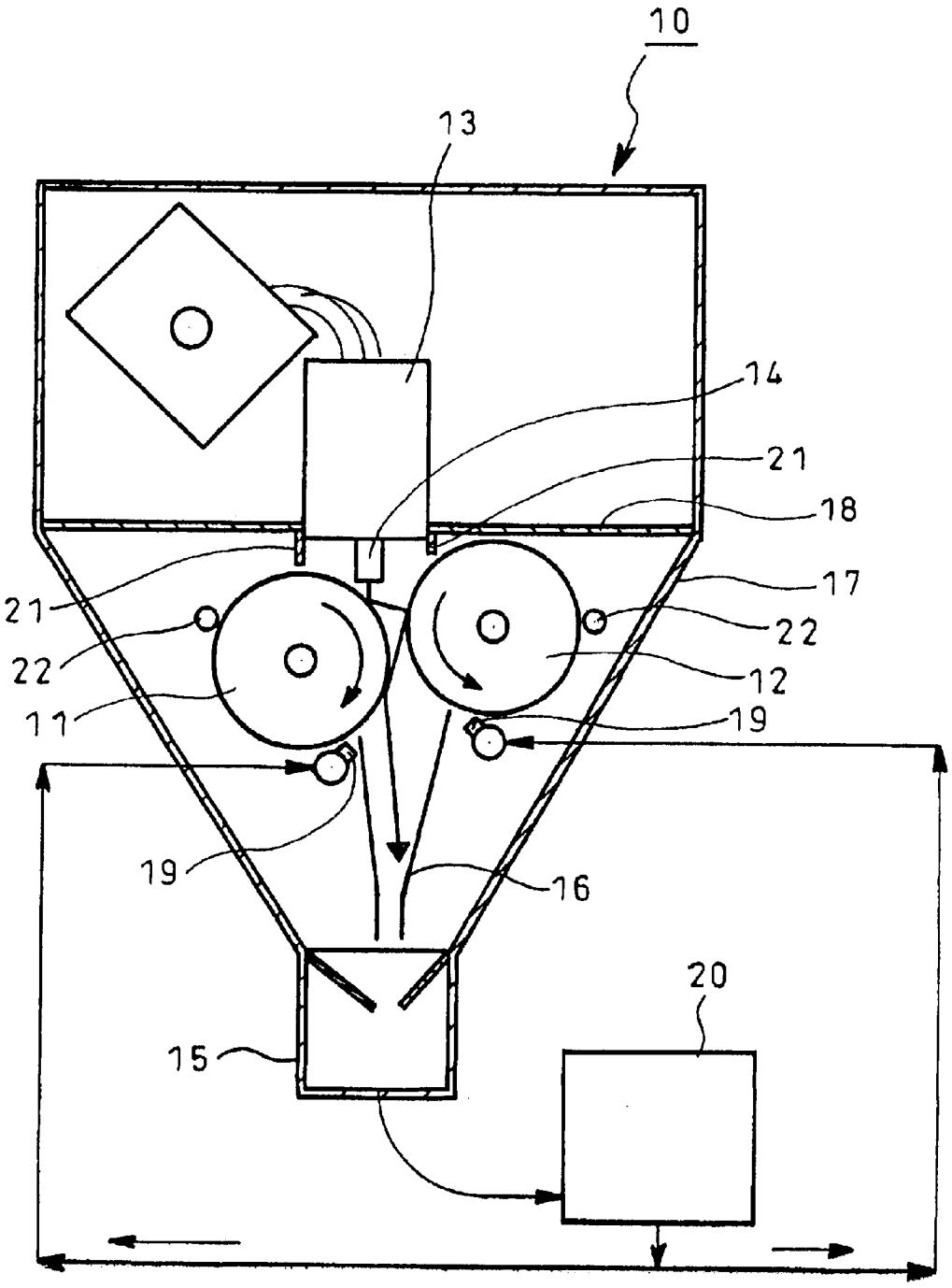
FIG. 2 is a schematic diagram of an embodiment of the metal-flake manufacturing apparatus according to the invention with two cooling rolls.

FIG. 2 is a schematic diagram of an embodiment of the metal-flake manufacturing apparatus according to the invention with two cooling rolls.

This metal-flake manufacturing apparatus 10 comprises two, hollow cooling rolls 11 and 12 which are internally cooled. The two cooling rolls 11 and 12 are arranged at different heights such that the second roll 12 downstream in the direction of supply of the molten metal has a rotational axis which is upwardly offset to that of the upstream, first cooling roll 11 and that the two cooling rolls 11 and 12 are spaced to have a gap of a size greater than thickness of metal thin bodies to be produced. The thickness of the produced metal thin bodies is substantially dependent upon cooling capability and rotational frequency of the cooling roll 11. If the thickness of the metal thin bodies is 50–60 $\mu$m, then the gap between the cooling rolls 11 and 12 is to be of the order of 3 mm.

These cooling rolls 11 and 12 are driven to rotate in opposite directions such that flakes are moved from above to below intermediately between the cooling rolls 11 and 12. They are driven by a drive (not shown) to rotate, for example, at peripheral velocities of the order of 10–50 m/sec.

Arranged above the first cooling roll 11 are a tundish 13 and a nozzle 14. Molten metal fed to the tundish 13 is ejected via the nozzle 14 onto the first cooling roll 11.

This nozzle 14 is arranged to eject the molten metal to a surface of the first cooling roll 11 at a point downstream of the top of the roll in the direction of its rotation, whereby the molten metal, even if excessively ejected, may be splashed not backwards but forward of the roll. For example, the nozzle 14 may be disposed such that the molten metal is ejected to the surface of the first cooling roll 11 at a point angularly downstream of the top of the roll in the direction of its rotation by 45° or so in terms of center angle.

The nozzle 14 may have one or more nozzle openings. The multiple openings may be arranged in parallel with the axis of the first cooling roll 11, which makes it possible to produce metal thin bodies in multiple streams; alternatively, a metal thin body with a large width may be produced, though it is not a requisite at all.

The nozzle 14 is arranged with a distance from the surface of the first cooling roll 11. This distance is set to be larger than that between the conventional single roll and nozzle since it is not necessary to produce a wide and continuous strip.

This nozzle 14 used has opening or openings which may be in the shape of circle or slot. In the case of the circular openings, their diameter is preferably no more than 3 mm and its sectional area, no more than about 7.1 $mm^2$ from the viewpoint of improving the yield of the produced metal flakes. However, those with the diameter of more than 3 mm and the sectional area of more than about 7.1 $mm^2$ are also allowable, in which case thicker metal flakes will result.

It should be noted that the nozzle opening shape is not limited to circular, provided that the stated a sectional area is secured.

Furthermore, if the nozzle 14 is provided with a heater/heat retainer or the like, the molten metal is prevented from-being solidified at the nozzle and thus a stable operation can be ensured.

Provided below such two cooling rolls 11 and 12 is a storage box 15 to collect metal flakes which have been obtained by hitting the metal thin bodies, which has been solidified on the first cooling roll 11, onto the second cooling roll 12 into flakes as well as by cooling and solidifying the molten metal, which are not cooled and solidified on the first cooling roll 11 but are splashed, on the second cooling roll 12.

For efficient withdrawal of the metal thin bodies to the storage box 15, a guide tube 16 is arranged between beneath the two cooling rolls 11 and 12 and the storage box 15, so that the metal flakes are collected in the storage box 15 without being scattered.

This metal-flake manufacturing apparatus 10 is entirely enclosed in a sealed container 17, allowing the metal flakes to be produced in an atmospheric gas such as an inert gas. The sealed container 17 is partitioned into upper and lower sections by a preload wall 18 at a bottom of the tundish 13.

Atmospheric gas supply nozzles 19 are disposed in the sealed container 17 below the rolls 11 and 12 such that the gas is ejected respectively from the nozzles to the flow of flakes produced by the rolls 11 and 12, whereby the produced metal flakes are cooled and can be guided to the storage box 15 using the flow of the inert gas.

The injected inert gas is sucked by a blower (not shown) via a gas suction inlet on the storage box 15, is cooled by a heat exchanger 20 and then re-supplied via the atmospheric gas supply nozzles 19 for circulation.

In this metal-flake manufacturing apparatus 10, whirls are generated by the cooling rolls 11 and 12 as the atmospheric gas such as inert gas is swirled due to high-velocity rotation of the cooling rolls in the atmospheric gas. In order to prevent the nozzle 14 from being cooled by the whirls and in order to prevent the metal thin bodies from being scattered by the whirls, windbreak plates 21 are protruded from the preload walls 18 at the sides of the nozzle 14 toward the cooling rolls 11 and 12.

Furthermore, in order to keep the surfaces of the cooling rolls 11 and 12 clean, a cleaning brush 22 in the form of roll is provided for each of the cooling rolls 11 and 12 in such a manner as to contact an outer periphery of each roll.

Mode of operation of the metal-flake manufacturing apparatus 10 thus constructed and manufacturing of metal flakes will be described.

With the metal-flake manufacturing apparatus 10 being supplied with the inert gas from the atmospheric gas supply nozzles 19, metal molten in a smelter is fed to the tundish 13 and is ejected onto the first cooling roll 11 which is driven to rotate and is internally cooled.

The molten metal, as it contacts the surface of the first cooling roll 11, is substantially solidified into a thin strip which is hit on a surface of and is crushed by the second cooling roll 12. The molten metal which was not solidified on the first cooling roll 11 but splashed forward into smaller chunks is hit on a roll surface of and is cooled and solidified by the second cooling roll 12, whereby the respective chunks of the molten metal are turned into flakes.

The metal thin bodies in the form of metal flakes thus obtained by the first and second cooling rolls 11 and 12 are further hit on the surface of and are further crushed into flakes by the first cooling roll 11, and are guided and withdrawn into the storage box 15 by the guide tube 16 as well as by the flow of the inert gas fed from the atmospheric gas supply nozzles 19.

Thus, the metal thin bodies produced through the respective steps are efficiently cooled by the atmospheric gas during their travels from the first cooling roll 11 to the second cooling roll 12, from the second cooling roll 12 back to the first cooling roll 11 and finally to the storage box 15 via the guide tube 16. Also in the storage box 15, they are cooled by the circulated inert gas. Thus, the metal flakes are efficiently cooled.

According to such metal-flake manufacturing apparatus 10, unlike the case of the single roll method, there is no need to adjust the amount of molten metal fed to the cooling roll for the purpose of forming a stable puddle between the nozzle and roll, which contributes to simplified operation; excess molten metal not solidified by the first cooling roll 11, if any, can be cooled by the second cooling roll 12 and withdrawn in the form of metal flakes, thereby substantially increasing the yield.

The metal flakes collected in the storage box 15, which are results not only of crushing by the second cooling roll but also of solidification from small chunks of molten metal, have bulk density increased in comparison with the conventionally stored thin strips and can be collected in stacked manner in the small-sized storage box 15.

Though in the form of flakes, they can be collected to the storage box 15 without being scattered since, according to this metal-flake manufacturing apparatus 10, the resultant metal flakes due to re-collision against the first cooling roll 11 are guided and withdrawn into the storage box 15 by the guide tube 16 and the flow of the inert gas supplied from the atmospheric gas supply nozzles 19.

Furthermore, according to this metal-flake manufacturing apparatus 10, the cooling rolls 11 and 12 are arranged not in contact with each other and there is no need to roll down the solidified metal between the rolls. As a result, the cooling rolls 11 and 12 require less drive power than in the prior-art double roll method, which contributes to substantial decrease of damage on the rolls.

Moreover, according to this metal-flake manufacturing apparatus 10, the atmospheric gas can be supplied for production of metal flakes in an atmosphere of inert gas, which contributes to production of metal flakes of high quality. Whirls caused by the swirling of the atmospheric gas, if any, can be blocked by the windbreak plates 21, thereby preventing cooling of the nozzle 14 and scattering of the metal flakes.

A crusher may be provided before the storage box 15 in this metal-flake manufacturing apparatus 10 for further crushing of the flakes.

In addition to the atmospheric gas supply nozzles 19, a cooler may be provided in or around the sealed container 17 so as to cool the metal flakes.

Further embodiments of the metal-flake manufacturing apparatus according to the invention will be described with reference to FIGS. 3A to 3C. Explanation on parts or elements similar to those in the above-described embodiment is omitted.

Figure 3A:
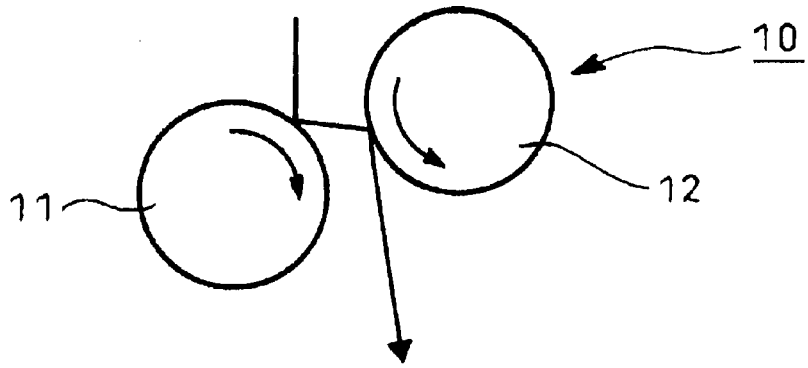
FIGS. 3A–3B and 3C show numbers and arrangements of the cooling rolls in further embodiments of the metal-flake manufacturing apparatus according to the invention.
Figure 3B:
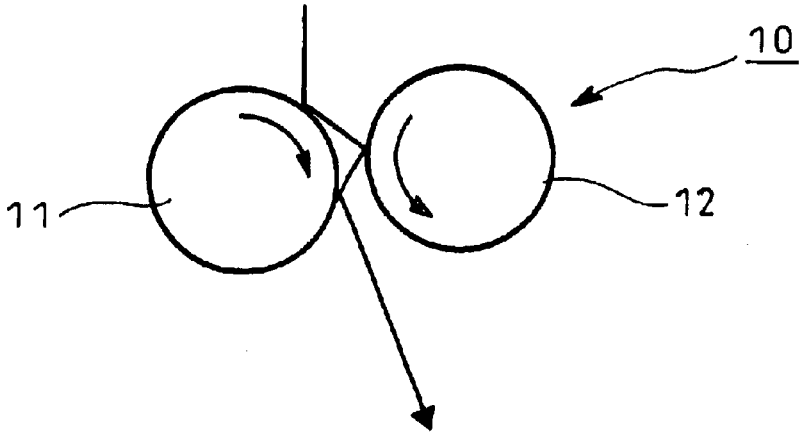
Figure 3C:
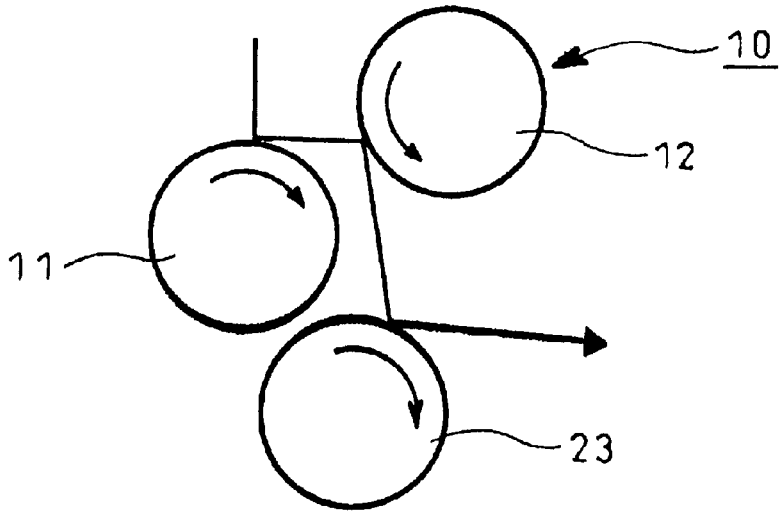

The metal-flake manufacturing apparatus 10 according to the invention has a plurality of cooling rolls the number and arrangement of which may be various; for example, as shown in FIG. 3A, two cooling rolls 11 and 12 may be used and arranged such that the metal thin bodies are first hit on the first cooling roll 11 and then on the second cooling roll 12 for withdrawal. Alternatively, as shown in FIG. 3B, the two rolls may be arranged such that the metal thin bodies are hit again on the first cooling roll 11 after its collision with the second cooling roll 12 before being withdrawn, thereby enhancing the crushing effects. Further alternatively, as shown in FIG. 3C, a third cooling roll 23 may be provided for further crushing of the metal flakes from the second cooling roll 12 as well as for change of the withdrawal direction into horizontal direction so as to suppress the overall height of the apparatus.

Except for the number and arrangement of the cooling rolls, the structural particulars of those alternative embodiments are the same as that of the embodiment initially described above.

Those metal-flake manufacturing apparatus 10 in which the number and arrangement of the cooling rolls are varied can also produce the metal flakes in a similar manner.

Thus, the metal-flake manufacturing apparatus according to the invention can stably produce the metal flakes even if the molten metal is ejected in larger quantity.

Since the thin strip can be crushed halfway during the process of manufacture, no separate crusher is required and the storage box can be of smaller size.

Moreover, the direction of collection of the metal flakes may be freely varied by varying the arrangement or number of the cooling rolls.

The damage to and the rotative drive power required for the cooling rolls can be reduced as compared with the conventional double roll method.

The metal flakes can be stably produced even if operational conditions such as shape of the nozzle may be varied in an extensive range, which is suitable for mass-production of metal flakes of constant quality.

Figure 4A:
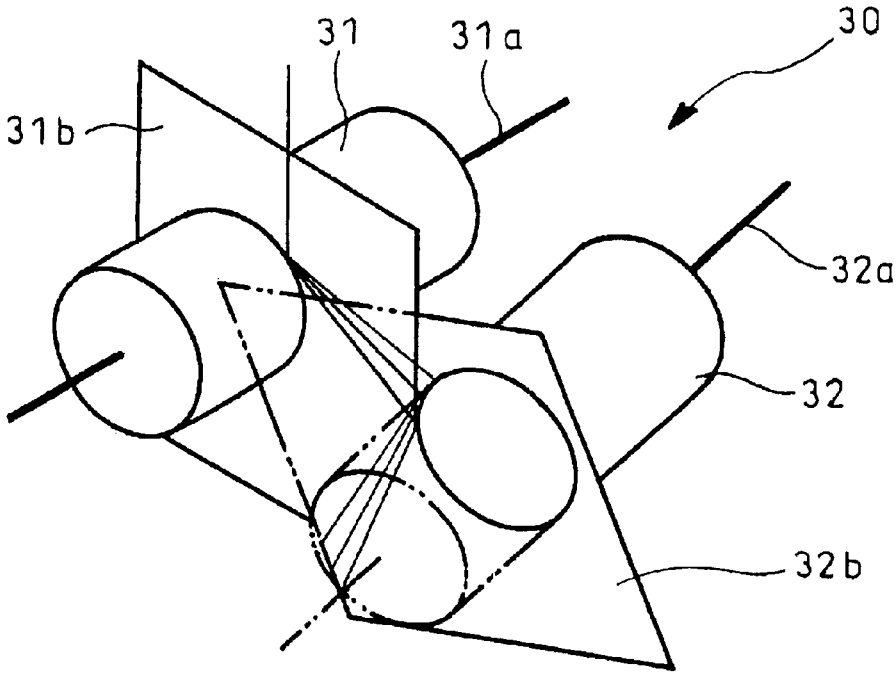
FIGS. 4A and 4B are schematic perspective and plan views, respectively, of an embodiment of the metal-flake manufacturing apparatus according to the invention.
Figure 4B:
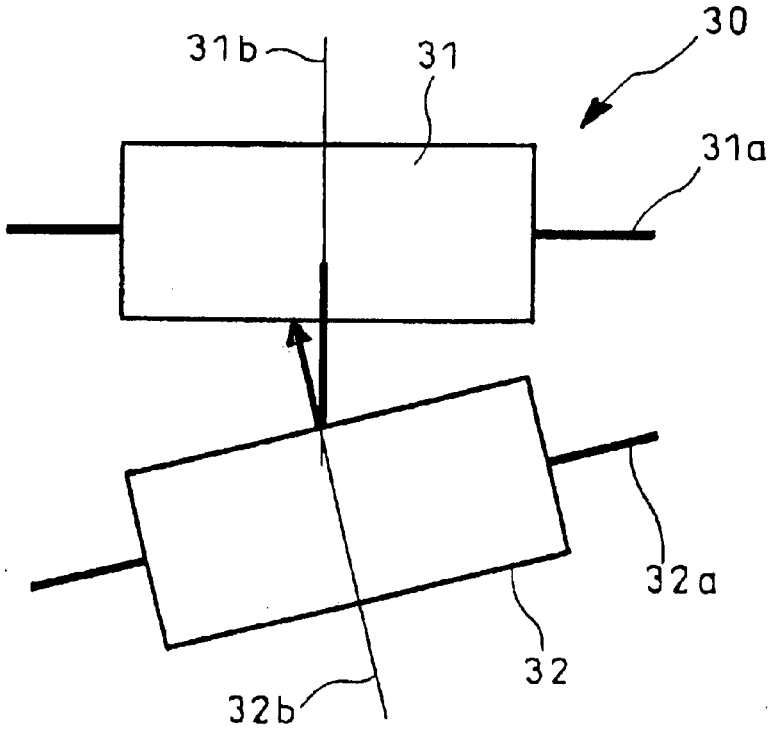

A still further embodiment of the metal-flake manufacturing apparatus according to the invention will be described with reference to the schematic perspective and plan views of FIGS. 4A and 4B. Explanation on parts or elements similar to those in the earlier embodiments is omitted.

A metal-flake manufacturing apparatus 30 according to the invention comprises a plurality of, for example two, cooling rolls 31 and 32 which have respectively rotational axes 31*a* and 32*a* not in parallel with each other. Here, as illustrated, the second cooling roll 32 is disposed lower than and has its rotational axis 32*a* skew to the rotational axis 31*a* of the first cooling roll 31, which arrangement is to alter the direction of withdrawal of the metal flakes after being hit on the first cooling roll 31 and then on the second cooling roll 32, so as to attain for example compact in size of the apparatus.

The remaining structural particulars other than the rotational axes of the cooling rolls are the same as those in the earlier embodiments.

Such metal-flake manufacturing apparatus 30 with the rotational axes 31*a* and 32*a* of the cooling rolls 31 and 32 being not in parallel with each other can still produce the metal flakes in the same manner. The molten metal ejected onto the first cooling roll 31 is solidified upon contact with the surface of the first cooling roll 31 into a thin strip which flies along a plane 31*b* perpendicular to the rotational axis 31*a* and is hit on the surface of the second cooling roll 32. On this second cooling roll 32, the metal thin strip having been solidified on the first cooling roll 31 is crushed into flakes while the splashed molten metal that failed to be solidified does contact the surface of the second cooling roll 32 to be cooled and solidified and turned into flakes, flying along a plane 32*b* perpendicular to the rotational axis 32*a* of the second cooling roll 32.

Accordingly, the flying direction of the metal flakes may be adjusted by varying the arrangement of the rotational axes 31*a* and 32*a* of the cooling rolls 31 and 32, which enhances the degree of freedom in arranging the apparatus.

The positioning of the cooling rolls is not limited to that in the above embodiment but may be chosen as desired depending upon a required flying direction. Also, the number of the cooling rolls is not limited to two and may be three or more so as to increase the degree of freedom in adjusting the flying direction.

Further embodiments of the metal-flake manufacturing apparatus according to the invention will be described with reference to FIGS. 5–7. Explanation on parts or elements similar to those already explained above is omitted.

Figure 5:
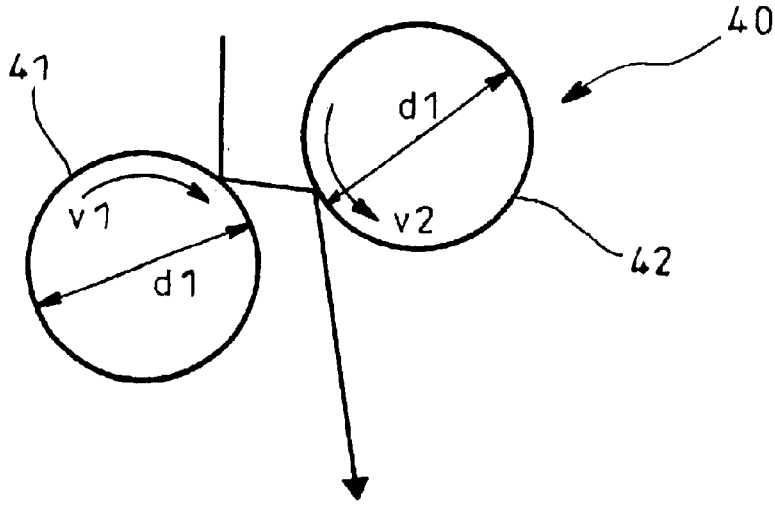
FIG. 5 is a schematic diagram of an embodiment of the metal-flake manufacturing apparatus according to the invention where two cooling rolls with the same diameter are used.
Figure 6:
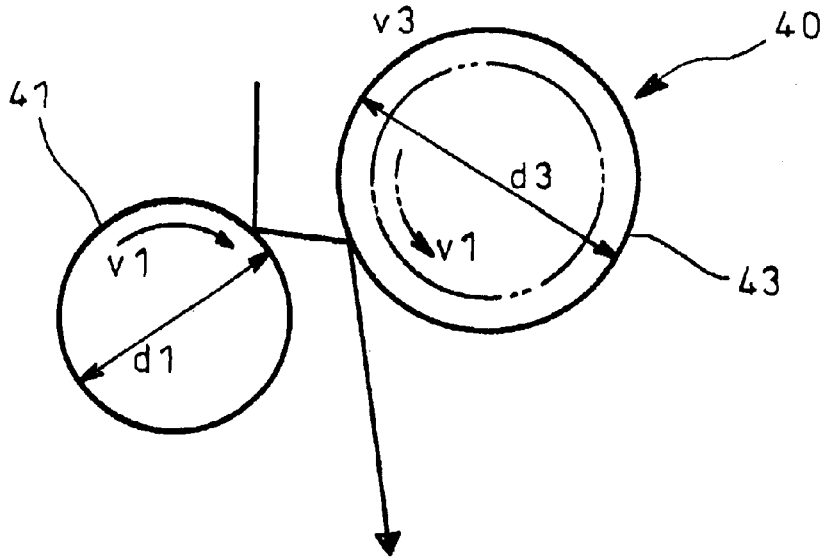
FIG. 6 is a schematic diagram of an embodiment of the metal-flake manufacturing apparatus according to the invention where two cooling rolls with different diameters are used.
Figure 7:
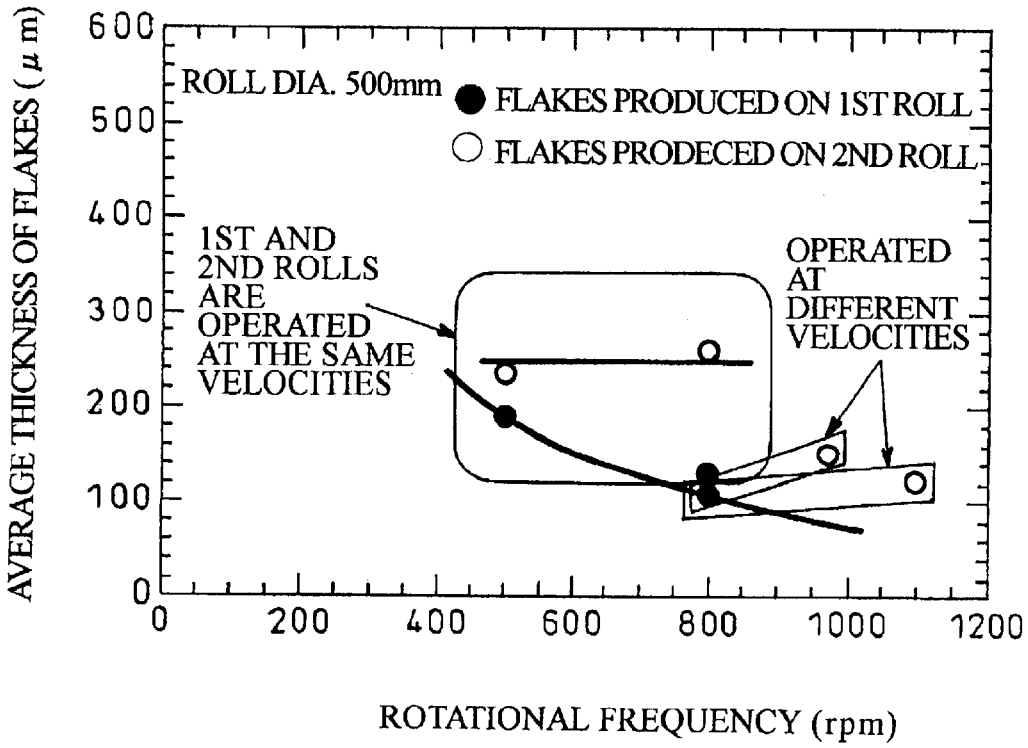
FIG. 7 is a graph showing the relationship between rotational frequency of rolls and average thickness of metal flakes in an embodiment of the metal-flake manufacturing apparatus according to the invention using two cooling rolls with the same diameter.

FIGS. 5–7 show further embodiments of the metal-flake manufacturing apparatus according to the invention. FIG. 5 is a schematic diagram with the two cooling rolls having the same diameter; FIG. 6 is a schematic diagram with the two cooling rolls having different diameters; and FIG. 7 shows a graph plotting the rotational velocity of the rolls against the average thickness of the metal flakes when the rolls have the same diameter.

In this metal-flake manufacturing apparatus 40 which has a plurality of, for example two, cooling rolls 41 and 42 adapted to have different peripheral velocities, which is achieved by, for example, differentiating rotational velocities v1 and v2 of the first and second cooling rolls 41 and 42 which have the same diameter as shown in FIG. 5; alternatively, the rolls may be driven to rotate at the same rotational frequency with, for example, the second cooling roll 43 being varied in diameter to have a varied peripheral velocity v3 as shown in FIG. 6.

Experiments were conducted to find the relationship between the rotational velocities (peripheral velocities at outer peripheries) of the rolls and the average thickness of the cooled and solidified metal flakes. Experimental results are as shown in FIG. 7.

It is known that in accordance with the conventional single roll method, the thickness of the manufactured flakes decreases as the rotational velocity of the roll increases.

On the other hand, when two cooling rolls are used, the thickness of the flakes manufactured by the first cooling roll decreases as the rotational velocity increases, as in the case of the single roll method. In the experiments, an average thickness of about 190 $\mu$m was measured with the rotation frequency of 500 rpm, and the average thickness was 100–120 $\mu$m when the rotation frequency was 800 rpm.

However, mean thickness of the flakes produced by the second cooling roll is greater than that by the first cooling roll when the first and second cooling rolls had the same velocity. In the experiments, the average thickness was substantially constant at about 240 $\mu$m whether the rotation frequency was 500 rpm or 800 rpm.

This is because flakes produced by the second cooling roll are made from the molten metal which has a higher velocity than that on the first cooling roll, which will decrease a relative rotational velocity (peripheral velocity) of the second cooling roll, resulting in correspondingly thicker flakes.

Thus, the average thickness of the flakes produced by the second cooling roll may be decreased by increasing the rotation frequency of only the second cooling roll. For example, the experiments revealed that flakes with substantially identical thickness can be obtained by setting the rotation frequencies of the first and second cooling rolls to be 800 rpm and 1150 rpm, respectively.

It is assumed that such decrease in the average flake thickness on the second cooling roll is determined by a peripheral velocity on its roll surface. Accordingly, as in the case of differentiating the rotational velocities of the first and second cooling rolls 41 and 42 with the same diameter, the reduction in the average flake thickness can be also achieved by differentiating the roll diameters when the first and the second cooling rolls 41 and 43 have the same rotational frequency.

Accordingly, when the two cooling rolls 41 and 42 are used in the metal-flake manufacturing apparatus 40, the rotational velocity v1 of the first cooling roll 41 is differentiated from that v2 of the second cooling roll 42 when the rolls have the same diameter as shown in FIG. 5. Alternatively, the diameter d1 of the first cooling roll 41 is differentiated from that d3 of the second cooling roll 43 when the two rolls are rotated at the same rotation frequency, so that the latter has a different peripheral velocity v3 as shown in FIG. 6. By thus increasing the peripheral velocity of the second cooling roll 42 or 43, the average flake thickness manufactured by the first cooling roll 41 and that by the second cooling roll 42 or 43 may be brought into substantially the same value.

Regardless of the peripheral velocities, the flakes produced by any of the cooling rolls 41, 42 or 43 have identical property, though the respective average thicknesses may be different.

Those embodiments have the same particulars as those in the earlier described embodiments except for the peripheral velocities of the cooling rolls, and can of course produce the same performance and advantageous effects. The embodiments may be further combined with the arrangement where the rotational axes are not in parallel with each other.

Further embodiments of the invention will be described with reference to FIGS. 8A, 8B and 9.

Figure 8A:
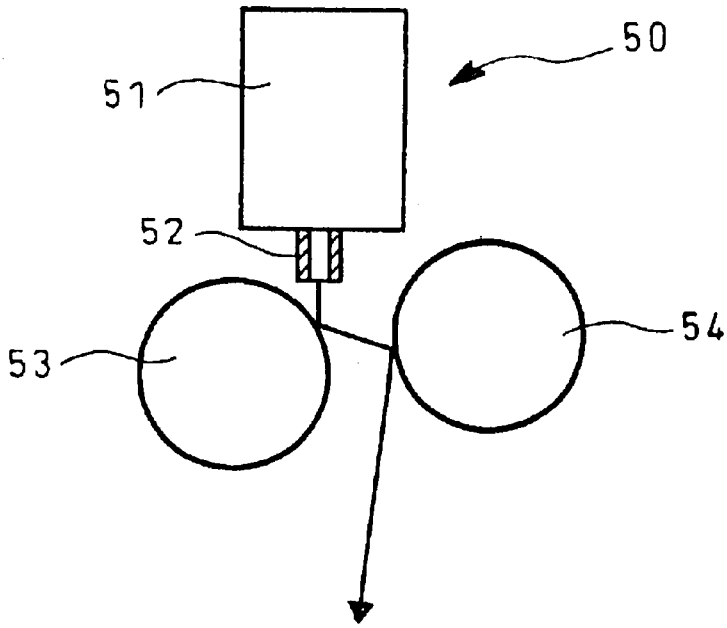
FIGS. 8A and 8B are sectional views of a nozzle portion of further embodiments of the metal-flake manufacturing apparatus according to the invention.
Figure 8B:
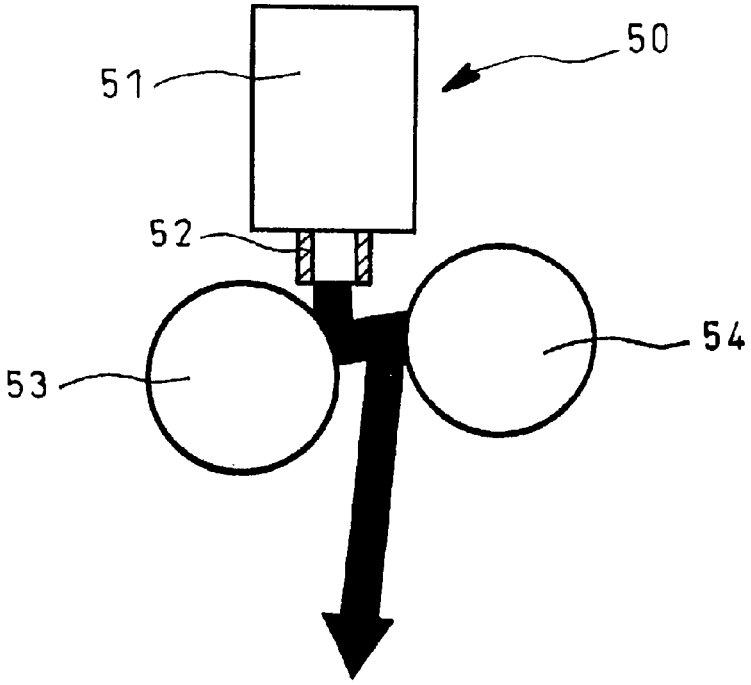
Figure 9:
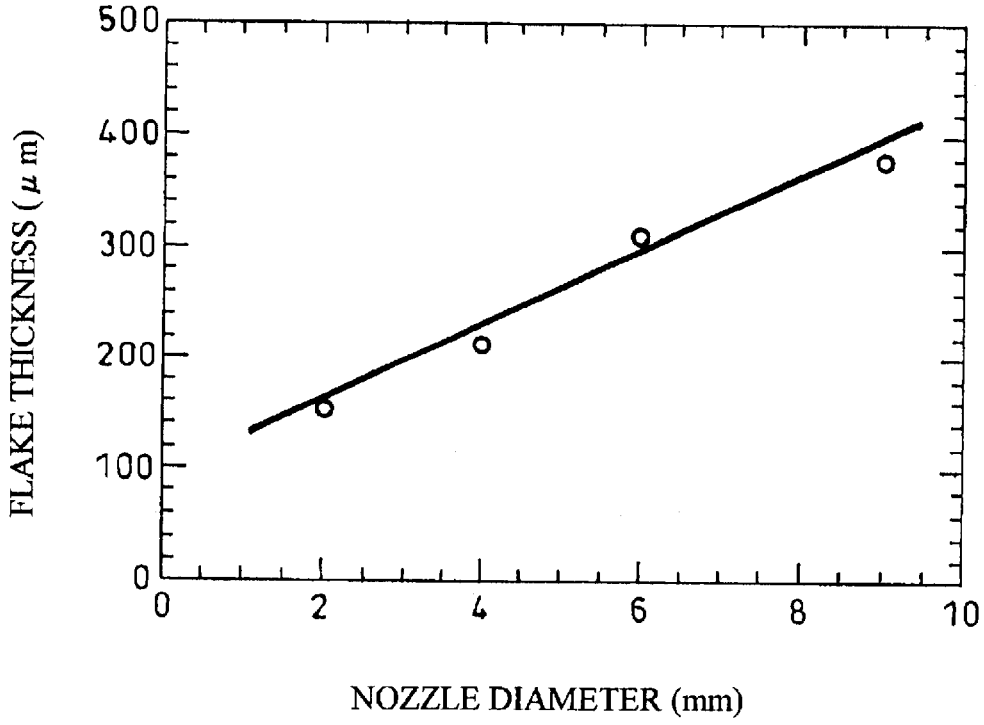
FIG. 9 is a graph showing the relationship between nozzle diameter and flake thickness in a still further embodiment of the metal-flake manufacturing apparatus according to the invention.

FIGS. 8A and 8B and 9 are sectional views of the nozzle portion and a graph plotting the nozzle diameter against the flake thickness in the further embodiments of the metal-flake manufacturing apparatus according to the invention.

As shown in FIG. 8A, the metal-flake manufacturing apparatus 50 has a nozzle 51 with a nozzle opening 52 increased in size. FIG. 8B shows the nozzle 51 with a nozzle opening 52 further increased in size. In the earlier described embodiments, the nozzle 14, when circular, had a diameter of 3 mm or less and a sectional area of 7.1 $mm^2$; however, here, used are the nozzle opening 52 with a diameter ranging from 1.0 to 10.0 mm and a sectional area ranging from 0.78 to 78 $mm^2$, which are larger than the diameter of 3 mm or less and the sectional area of 7.1 $mm^2$.

The increase in diameter of the nozzle opening 52 results only in an increase in the average thickness of the produced metal flakes, and does not cause any problems in their property. They can be used as materials as they are.

As the diameter of the nozzle opening 52 is increased, more molten metal flies to the second cooling roll 54 without being solidified on the first cooling roll 53. Consequently, such molten metal flies radially in a plane perpendicular to the axis of the first cooling roll 53. Accordingly, the amount of molten metal that accumulates during contact of the solidified metal flakes to the surface of the second cooling roll 54 increases, thereby producing thicker flakes.

The experiments using aluminum alloys revealed that the average thickness of the flakes (metal flakes) increases as the sectional area (diameter) of the nozzle opening is increased as shown in FIG. 9.

The nozzle opening diameter may be in the range from 6 to 10 mm and its sectional area from 28 to 78 $mm^2$, which values are unusually large compared with those used in the conventional manufacture of the metal flakes. Still, there can be obtained metal flakes in a highly efficient manner.

The resultant metal flakes have no problems in their property and can be used as materials as they are.

Thus, the metal-flake manufacturing apparatus 50 may mass-produce thicker metal flakes efficiently by increasing the size of the nozzle opening 52 of the nozzle 51.

The nozzle opening is not limited to circular in shape and may be shaped otherwise.

Thus, the metal-flake manufacturing apparatus according to the invention can manufacture metal flakes in a stable manner even when there is a large amount of molten metal ejected.

Since the thin strip can be crushed halfway during the process of manufacture, no separate crusher is required and the storage box can be of smaller size.

Moreover, the direction of collection of the metal flakes may be freely varied by varying the arrangement or number of the cooling rolls.

The damage to and the rotative drive power required for the cooling rolls can be reduced as compared with the conventional double roll method.

The metal flakes can be stably produced even if operational conditions such as shape of the nozzle may be varied in an extensive range, which is suitable for mass-production of metal flakes of constant quality.

As concretely described above with reference to the embodiments, according to the metal-flake manufacturing apparatus of the invention, a plurality of cooling rolls are spaced to have a gap of a size greater than thickness of metal thin bodies to be produced. A nozzle is provided to eject molten metal onto a surface of such cooling roll. The first cooling roll quenches the molten metal from the nozzle into metal thin bodies. On the next cooling roll, the produced metal thin bodies are hit into flakes while the excess molten metal is made into metal thin bodies. Thus, freedom in supply of molten metal is enhanced and metal flakes can be stably and efficiently produced.

The cooling rolls are arranged at different heights so that the produced metal thin bodies are sequentially hit on the rolls, which increases chances of the produced metal thin bodies being hit on the cooling rolls and contributes to obtaining further finer flakes and changeability of the flake withdrawal direction.

Rotational axes of the cooling rolls may be out of parallelism so that a flying direction of the metal thin bodies, which is on a plane perpendicular to the rotational axis, may be changed with increased freedom.

Moreover, the cooling rolls may be arranged to rotate at different peripheral velocities. Differentiation in peripheral velocity between the cooling rolls will contribute to controlling the thickness of the metal thin bodies produced; if the cooling rolls with the same diameter were driven to rotate at the same peripheral velocity, thinner and thicker metal flakes would be produced on the upstream and downstream rolls, respectively.

In addition, the cooling rolls may have different diameters so as to have different peripheral velocities, which will contribute, just like the above, to controlling the thickness of the metal thin bodies.

The nozzle may have a plurality of nozzle openings along the axis of the cooling roll. Provision of the nozzle openings in the shape of, for example, slot or circle, along the axis of the roll will contribute to further effective production of metal flakes.

The respective nozzle openings may have a sectional area of 0.78–78 $mm^2$. Even with the nozzle-openings having the sectional area as large as of 28–78 $mm^2$, which are unusually large as compared with those in the conventional production of metal flakes, thick metal flakes can be produced with higher efficiency.

The nozzle and the cooling rolls may be placed in atmospheric gas and windbreak members may be arranged to prevent the atmospheric gas from being swirled by the rotating cooling rolls. Manufacturing in the atmosphere such as inert gas will enhance the quality of the metal flakes produced. Prevention of the atmospheric gas from being swirled by the rotating cooling rolls will prevent the nozzle from being cooled and prevent the metal flakes from being scattered.

Furthermore, gas from atmospheric gas supply nozzles may be directed to guide the metal flakes towards a storage box in which metal flakes are to be stored, which will prevent the metal flakes from being scattered and contribute to efficient collection of the metal flakes in the box.

The storage box may have a cooler for cooling the collected metal flakes, which will contribute to further improvement of the metal flake cooling efficiency.

INDUSTRIAL APPLICABILITY

The present invention provides a metal-flake manufacturing apparatus for manufacturing, in a simple and efficient manner, quenched metal-flake materials required for manufacture of thermoelectric materials, magnet materials, hydrogen storage alloys or the like.

What is claimed is:

1. A metal-flake manufacturing apparatus comprising, a first cooling roll, a nozzle is arranged to eject molten metal on a surface of the first cooling roll not tangentially but in a direction of collision with the latter, said first cooling roll adapted to quench the molten metal from the nozzle through collision into metal thin bodies and fly the produced metal thin bodies, and at least a second cooling roll on which the produced flown metal thin bodies are hit into flakes, said second cooling roll also serving for solidification of the molten metal not solidified by the first cooling roll, said cooling rolls being spaced apart by a gap of a size greater than thickness of metal thin bodies.

2. A metal-flake manufacturing apparatus according to claim 1, wherein said plurality of cooling rolls are arranged at different heights so that the produced metal thin bodies are sequentially hit on the rolls.

3. A metal-flake manufacturing apparatus according to claim 1, wherein rotational axes of said cooling rolls are mutually out of parallelism.

4. A metal-flake manufacturing apparatus according to claim 1, wherein said cooling rolls are adapted to have different roll diameters.

5. A metal-flake manufacturing apparatus according to claim 1, wherein said nozzle has a plurality of nozzle openings along an axis of the cooling roll.

6. A metal-flake manufacturing apparatus according to claim 5, wherein the nozzle openings of said nozzle have a sectional area of 0.78–78 $mm^2$.

7. A metal-flake manufacturing apparatus according to claim 1, wherein said nozzle and said cooling rolls are placed in atmospheric gas and windbreak members are arranged to prevent the atmospheric gas from being swirled by the rotating cooling rolls.

8. A metal-flake manufacturing apparatus according to claim 7, wherein gas from atmospheric gas supply nozzles for supplying said atmospheric gas is directed to guide the metal flakes toward a storage box in which metal flakes are to be stored.

9. A metal-flake manufacturing apparatus according to claim 8, wherein said storage box has a cooler for cooling the metal flakes stored.

10. A metal-flake manufacturing apparatus comprising, a first cooling roll, a nozzle is arranged to eject molten metal on a surface of the first cooling roll not tangentially but in a direction of collision with the latter, said first cooling roll adapted to quench the molten metal from the nozzle into metal thin bodies and at least a second cooling roll on which the produced metal thin bodies are hit into flakes, said second cooling roll also serving for solidification of the molten metal not solidified by the first cooling roll, said cooling rolls being spaced apart by a gap of a size greater than thickness of metal thin bodies, and a crushing member configured to crush the metal flakes, wherein said nozzle and said cooling rolls are placed in atmospheric gas and windbreak members are arranged to prevent the atmospheric gas from being swirled by the rotating cooling rolls.

11. A metal-flake manufacturing apparatus according to claim 10, wherein gas from atmospheric gas supply nozzles for supplying said atmospheric gas directed to guide the metal flakes toward a storage box in which metal flakes are to be stored.

12. A metal-flake manufacturing apparatus according to claim 11, wherein said storage box has a cooler for cooling the metal flakes stored.

* * * * *